US007421984B2

(12) United States Patent
Braun et al.

(10) Patent No.: US 7,421,984 B2
(45) Date of Patent: Sep. 9, 2008

(54) METHOD FOR ADJUSTING A COOLANT FLOW BY MEANS OF A HEATING CUT-OFF VALVE

(75) Inventors: Hans Braun, Stuttgart (DE); Ralf Körber, Stuttgart (DE); Michael Timmann, Eutingen (DE); Jochen Weeber, Filderstadt (DE)

(73) Assignee: DaimlerChrysler AG, Stuttgart (DE)

( * ) Notice: Subject to any disclaimer, the term of this patent is extended or adjusted under 35 U.S.C. 154(b) by 122 days.

(21) Appl. No.: 10/568,189

(22) PCT Filed: Jul. 31, 2004

(86) PCT No.: PCT/EP2004/008616

§ 371 (c)(1),
(2), (4) Date: May 17, 2006

(87) PCT Pub. No.: WO2005/017328

PCT Pub. Date: Feb. 24, 2005

(65) Prior Publication Data

US 2007/0028862 A1 Feb. 8, 2007

(30) Foreign Application Priority Data

Aug. 14, 2003 (DE) ..... 103 37 413

(51) Int. Cl.
*F01P 3/00* (2006.01)

(52) U.S. Cl. ..... 123/41.29; 123/41.08; 237/12.3 B

(58) Field of Classification Search ..... 123/41.01, 123/41.02, 41.08, 41.13, 41.29; 236/DIG. 2; 237/9 A, 12.3 B
See application file for complete search history.

(56) References Cited

U.S. PATENT DOCUMENTS

| | | | | | |
|---|---|---|---|---|---|
| 2,471,514 | A | * | 5/1949 | Branson | 236/DIG. 2 |
| 2,706,085 | A | * | 4/1955 | Nallinger | 237/12.3 B |
| 3,211,374 | A | * | 10/1965 | Matulaitis | 237/12.3 R |
| 3,921,600 | A | * | 11/1975 | Henning et al. | 123/41.08 |
| 4,930,455 | A | | 6/1990 | Creed et al. | |
| 6,325,026 | B1 | * | 12/2001 | Suzuki | 123/41.1 |

FOREIGN PATENT DOCUMENTS

| | | | |
|---|---|---|---|
| DE | 40 33 261 | A | 4/1992 |
| DE | 44 32 292 | A1 | 3/1996 |
| DE | 100 12 197 | A1 | 9/2001 |
| EP | 0 900 924 | A | 3/1999 |
| EP | 0 965 737 | A | 12/1999 |
| FR | 2 776 707 | A | 10/1999 |
| WO | WO-03/006857 | A | 1/2003 |

* cited by examiner

*Primary Examiner*—Noah Kamen
(74) *Attorney, Agent, or Firm*—Norman N. Kunitz; Fitch, Even, Tabin & Flannery

(57) ABSTRACT

The invention relates to a method for actuating the valves in the three-way thermostat and in the heating cut-off valve of a cooling system. The valve setting in the cooling system is in this case selected such that during the warm-up phase of the engine, until the latter has reached its operating temperature, the coolant in the cooling ducts is brought to rest until the coolant temperature exceeds a predefined reference value.

5 Claims, 4 Drawing Sheets

METHOD FOR ADJUSTING A COOLANT FLOW BY MEANS OF A HEATING CUT-OFF VALVE

CROSS REFERENCE TO RELATED APPLICATION

This application is the National Stage filing under 35 U.S.C. 371 of International Application No. PCT/EP2004/008616, filed Jul. 31, 2004, and claims priority of German Patent Application 103 37 413.2, filed Aug. 14, 2003.

BACKGROUND OF THE INVENTION

The invention relates to the adjustment of the coolant flow by means of a heating cut-off valve, in particular for a cooling system in a motor vehicle. During the warm-up phase of the internal combustion engine, the heating cut-off valve acting together with a three-way thermostat ensures that coolant is stationary in the coolant ducts of the engine block so that the warm-up phase of the internal combustion engine takes as short a time as possible.

The invention proceeds from a prior art as is for example known from the German patent application DE 100 12 197 A1. In this cooling system for an internal combustion engine, too, a cut-off valve in the coolant line between an engine block and a heating heat exchanger, and a three-way valve for switching between a large and a small coolant circuit, act together in order to shorten the warm-up phase of the internal combustion engine to as great a degree as possible.

For this purpose, however, the waste heat from a climate control unit is utilized in order to heat the coolant with the waste heat from the heating heat exchanger of the climate control unit when the engine is still cold.

The coolant heating from DE 100 12 197 A1 has the disadvantage that it is only effective in conjunction with a climate control unit, even this only being the case if the ambient conditions are such that a climate control unit generates an appreciable quantity of waste heat as a result of cooling activity. This is generally the case when starting a motor vehicle in summer if the vehicle has been standing in the sun. At warm ambient temperatures, however, the warm-up phase of an internal combustion engine is not very long, so that in summer, compliance with emissions limits is not a problem. These problems occur more intensely at cold ambient temperatures as are encountered in winter in the northern hemisphere. However, the climate control unit then produces no waste heat, so that the abovementioned heating of the coolant is not available when it is needed most.

DE 44 32 292 A1 discloses a cooling system for an internal combustion engine in a motor vehicle, in which the coolant flow through a heating heat exchanger is adjusted in order to assist the internal combustion engine in warming up. However, a very complex distributor device having a total of 6 valves is proposed for this purpose. The complex distributor device is necessary since the coolant pump is driven permanently and thus the coolant flow through the heating heat exchanger is required as a bypass for the disconnected coolant cooler. Three-way thermostats or three-way valves are not used. DE 44 32 292 A1 does not therefore form a generic prior art for the invention claimed here.

A number of approaches are known from the previously known prior art for shortening the warm-up phase of an internal combustion engine to as great a degree as possible. Previously, however, a permanent coolant flow has always been maintained in the engine block, even during the warm-up phase of the internal combustion engine. For this purpose, valves were used to adjust the coolant flow through the heating heat exchangers.

It is therefore an object according to the invention to further improve the control of the coolant flow through the heating heat exchangers, in order to be able to further shorten the warm-up phase of an internal combustion engine.

SUMMARY OF THE INVENTION

The above object generally is achieved according to the present invention by a method for adjusting the coolant flow from the cooling ducts of an internal combustion engine into a heating heat exchanger with a cut-off valve, wherein the coolant flow into the heating heat exchanger is interrupted by the cut-off valve if the temperature of the coolant is below a predefined reference temperature, and the coolant flow in the combustion ducts is thus stopped. Further advantageous embodiments are described in and description of the exemplary embodiments.

The solution is successful primarily by means of suitable actuation of the valves in the three-way thermostat and in the heating cut-off valve. The valve setting in the cooling system is in this case selected such that during the warm-up phase of the engine, until the latter has reached its operating temperature, the coolant in the cooling ducts is brought to rest until the coolant temperature exceeds a predefined reference value.

In one advantageous embodiment of the invention, the heating cut-off valve can, if the coolant temperature has exceeded a preliminary threshold, be opened for a short time in order to allow pre-warmed coolant to flow around the wax pellet in the three-way thermostat.

Thereafter, the coolant is prevented from flowing in the cooling ducts of the internal combustion engine again until the operating threshold is reached. The temporary opening prepares the three-way thermostat for the imminent start of operation as a thermostat for controlling the coolant temperature.

In another advantageous embodiment of the invention, overload protection is realized for preventing local overheating in the internal combustion engine during the warm-up phase. For this purpose, an expected coolant target temperature is calculated as a function of the engine parameters, in particular as a function of the load torque which is present and the current engine speed. If whilst the coolant is stationary in the internal combustion engine, that is to say if the coolant ducts are closed off, the actual coolant target temperature is below the expected target temperature in spite of the presence of a high load, this is an indication of boundary layer formation in the cooling ducts which prevents heat transfer when the coolant is stationary. There is then a danger of the internal combustion engine overheating. In this case, the coolant flow is started up in the cooling ducts even if the coolant temperature has not yet reached the opening temperature for the cut-off valves. As an alternative to opening the heating cut-off valve, the wax pellet in the three-way thermostat can also be subjected to flow in order to provide protection from overheating.

Exemplary embodiments of the invention are described in more detail in the following on the basis of the figures.

DETAILED DESCRIPTION OF THE INVENTION

Figure 1:
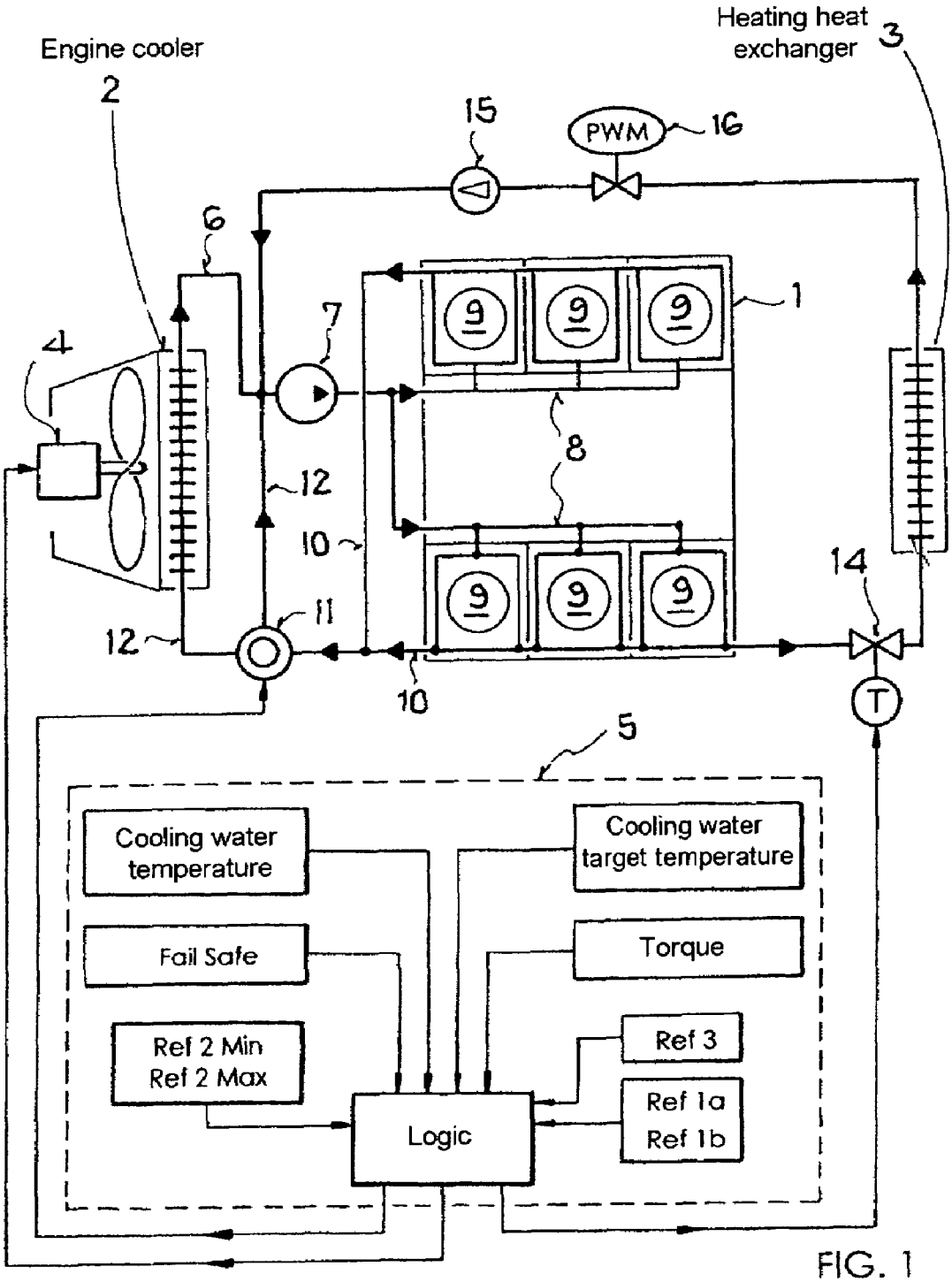
FIG. 1 shows a schematic diagram of a cooling system having the most important influential parameters for actuating the heating cut-off valve.

FIG. 1 schematically shows a typical cooling system for a six-cylinder internal combustion engine 1. In addition to the internal combustion engine, a vehicle cooler 2 and a heating heat exchanger 3 are integrated in the cooling system. The cooling power of the vehicle cooler can be influenced by means of an electrically driven fan 4. In order to adjust the fan power, the electric motor of the fan is controlled by a control unit 5. Cooled coolant is taken from the vehicle cooler by means of the advance line 6 and is fed by means of the coolant pump 7 into the cooling lines 8 in order to be fed to the cooling ducts (not illustrated in more detail) for the combustion cylinders 9. The heated coolant is led from the combustion cylinders 9 to a three-way thermostat 11 by means of return lines 10. Depending on the setting of the valves in the three-way thermostat 11, the coolant travels out of the internal combustion engine back into the vehicle cooler via the cooler return 12 or back into the cooling lines 8 of the internal combustion engine via the cooler short circuit 13 and the coolant pump 7.

Depending on the setting of the valves in the three-way thermostat 11, the cooling system can in this case and in a manner known per se be operated in a short circuit operating mode, in a mixed operating mode or with the large cooling circuit. The heating heat exchanger 3 is connected by means of a temperature-controlled cut-off valve 14 to the high-temperature branch of the cooling system in the internal combustion engine. The flow rate through the heating heat exchanger after the cut-off valve 14 is opened can, in order to adjust the heating power, be adjusted by means of an additional electric coolant pump 15 and a synchronized cut-off valve 16.

Figure 2:
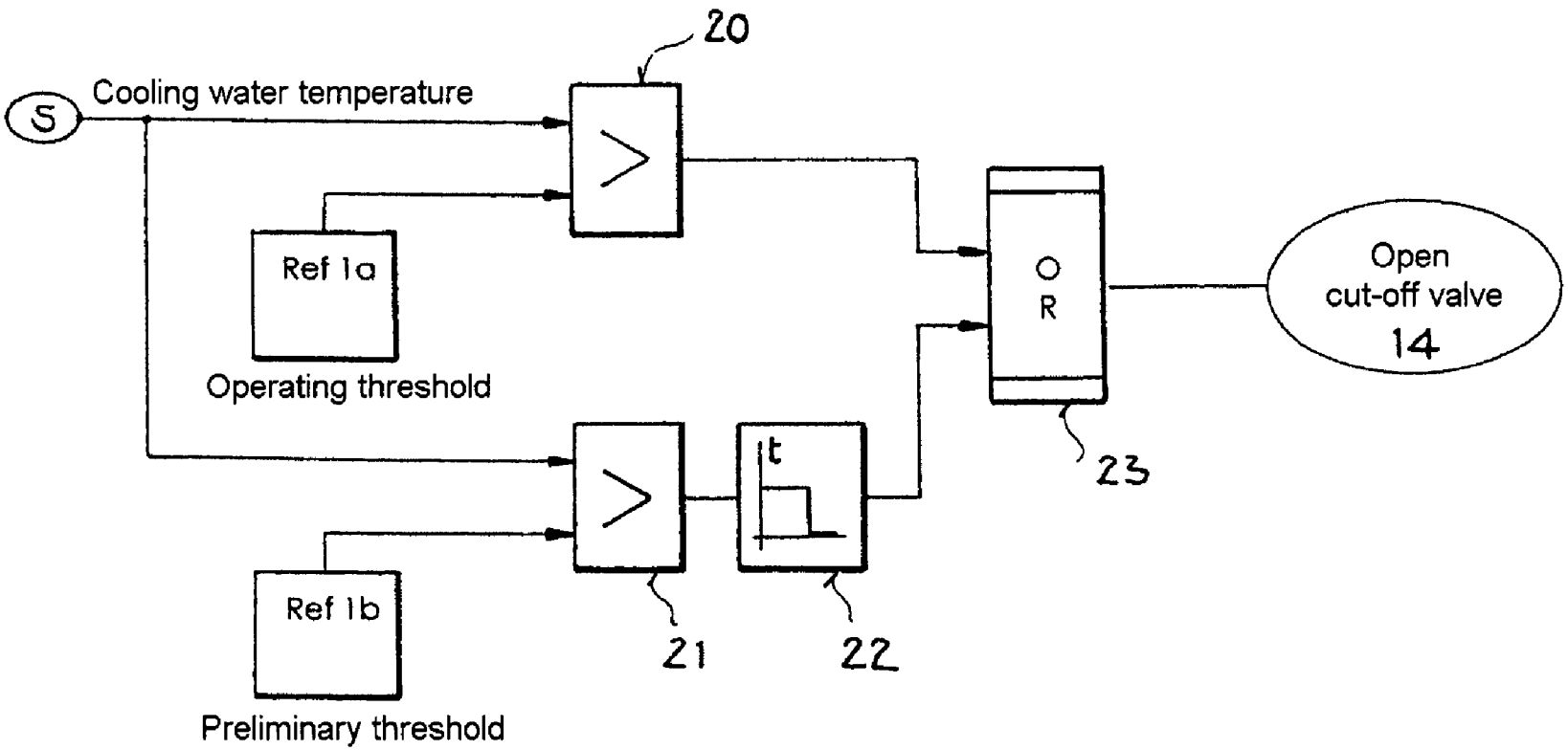
FIG. 2 shows a preliminary controller for pre-heating a three-way thermostat in the cooling circuit.
Figure 3:
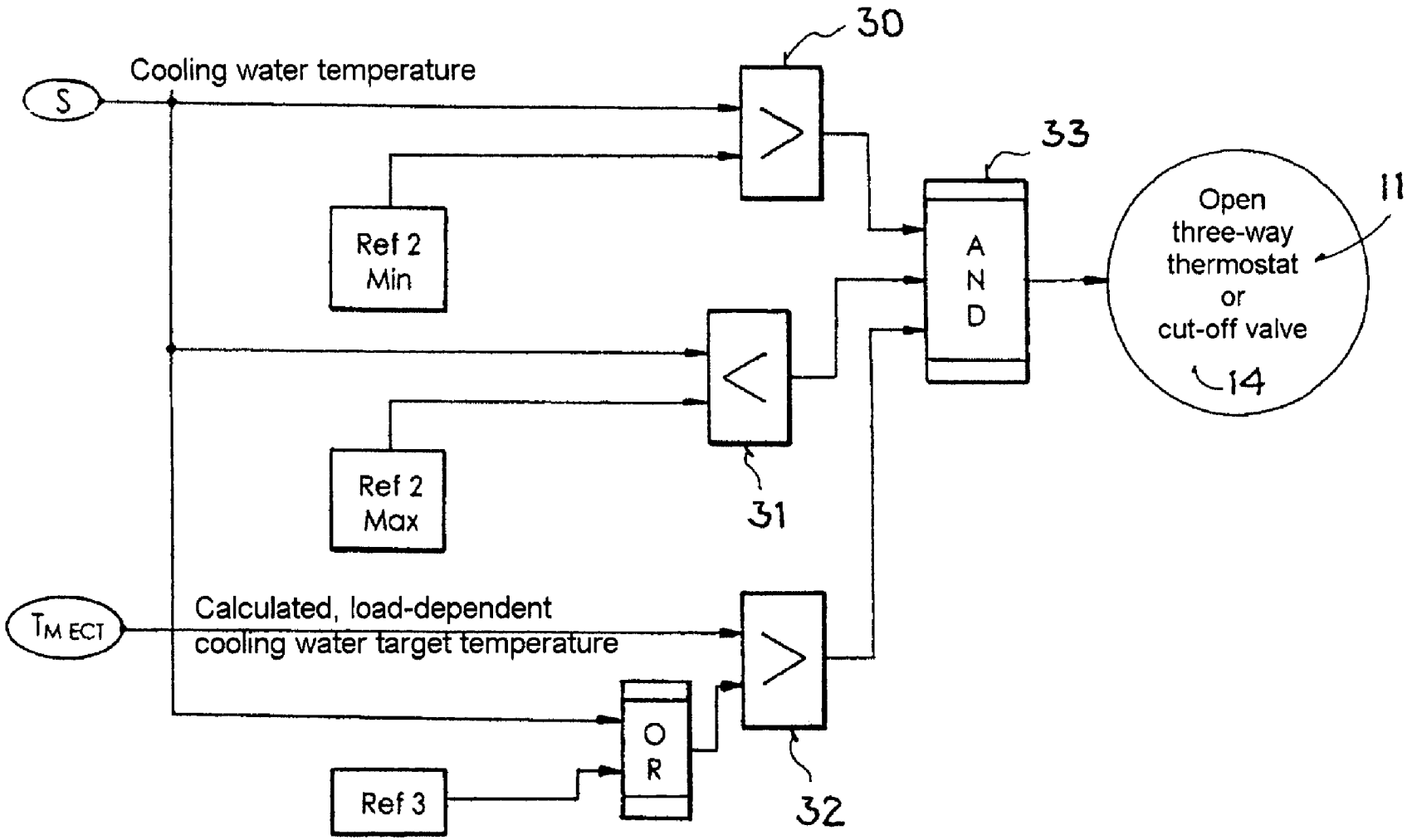
FIG. 3 shows a method for overload protection whilst the coolant is stationary in the cooling ducts of the internal combustion engine.

The actuation of the actuating elements on the valves of the three-way thermostat 11 is set in this case by the control unit 5. A logic component Logic in the form of a microelectronic processor is contained in the control unit. The control unit is preferably formed by the control unit of the engine electronics. In the logic component, the control algorithms sketched in FIGS. 2 and 3 are implemented in the form of software programs. The most important operating data for the adaptation of the control parameters are in this case the cooling water temperature, the coolant target temperature, a failure recognition signal Failsafe, the current torque which is present at the internal combustion engine and also various reference values Ref2Min, Ref2Max, Ref3, Ref1*a* and Ref1*bn* which are significant for the decision processes as discussed in conjunction with FIGS. 2 and 3. Finally, the cut-off valve 14 is opened or closed by means of the control unit 5 as a function of the decision routines in the control unit. To enable the internal combustion engine to reach its operating temperature as quickly as possible, the coolant flow in the cooling ducts of the internal combustion engine can, with suitable valve setting in the three-way thermostat 11, be brought to rest by means of the heating cut-off valve 14 until a threshold temperature is reached at which the coolant flow is then started up and the internal combustion engine is thus cooled. The interruption according to the invention of the cooling during the warm-up phase of the internal combustion engine results in the latter reaching its operating temperature more quickly.

In this case, the heating cut-off valve 14 initially remains closed until the cooling water temperature exceeds at least one temperature threshold value. The corresponding decision algorithm is graphically illustrated in a simplified manner in FIG. 2. The decision algorithm is implemented as a software program in the control unit 5. The cooling water temperature which is determined by means of a sensor S is compared with a predefined and stored reference value Ref1*a* by means of a magnitude comparison 20 which is preferably realized in terms of programming. Said reference value is in this case an engine-specific temperature reference value which indicates the operating threshold for activating the coolant flow. If the current cooling water temperature exceeds this engine-specific operating threshold, a subsequent logic in the control unit 5 sends the corresponding control signal for opening the heating cut-off valve to its actuators, and the heating cut-off valve is opened for operating the vehicle heating.

The operating threshold can advantageously be assigned a second, lower temperature threshold Ref1*b* as a preliminary threshold and be connected in parallel in terms of programming. If the cooling water temperature exceeds the preliminary threshold, the heating cut-off valve can be temporarily opened in order to effect a flow of previously heated cooling water via the wax pellet in the three-way thermostat 11. As a result, the three-way thermostat is prepared for the imminent start of operation of the cooling system. Expediently, the cooling water temperature is exceeded by means of a programmed comparison step 21 and the heating cut-off valve is temporarily opened by means of a programmed time controller 22. The two program loops for monitoring the operating threshold and for monitoring the preliminary threshold can alternatively be supplied by means of an OR-gate 23 to the subsequent process controller.

Stationary cooling water in the cooling ducts of the internal combustion engine holds the danger of local overheating in the internal combustion engine as a result of boundary layer formations which, when the cooling water is stationary, can form largely unnoticed by the temperature sensor. It is therefore advantageous to make safety provisions, by means of which local overheating can be prevented in good time. One possibility for this is shown by the exemplary embodiment of FIG. 3.

A temperature sensor S and two comparison steps 30, 31 monitor whether the cooling water temperature is in a range between an upper reference value Ref2Max and a lower reference value Ref2Min. The expected load-dependent cooling water target temperature TM_ECT is calculated by means of an engine model from the current torque or preferably the current torque profile. This cooling water target temperature is compared as overload protection to a further reference value Ref3 by means of a further comparison step 32. If the cooling water temperature calculated from the engine load is above a limit value for overload protection, or if the calculated cooling water temperature is above the current cooling water temperature and if at the same time the cooling water temperature is in a temperature range below the operating threshold of the cooling system, the coolant flow is started up as a precautionary measure in order to prevent local overheating for reasons of safety. The coolant flow is effected by alternatively opening the heating cut-off valve 14 or by a suitable valve setting in the three-way thermostat 11. The exemplary embodiment in FIG. 3 favors the simultaneous existence of two conditions for starting up the early coolant flow, namely that the cooling water temperature must be in a certain temperature interval between a lower reference value Ref2Min and an upper reference value Ref2Max and that the load-dependent calculated cooling water target temperature must be above a comparison value. In terms of programming, these two conditions are combined by means of an AND-gate 33. This approach has the advantage that if the cooling water temperature is not in the predefined temperature interval, the calculation of a load-dependent cooling water target temperature remains unconsidered and can be omitted. If the engine has reached its operating temperature, the overload protection and thus the calculation of a load-dependent cooling water target temperature can therefore be switched off by retrieving the temperature interval. This relieves the processing capacity in the control unit 5 of load.

In a more simple embodiment, overload protection can also be obtained by means of simple comparison of the calculated, load-dependent cooling water target temperature TM_ECT with a comparison temperature, either the actual cooling water temperature or with a reference value Ref3. The coolant flow is then effected by opening the corresponding valves every time the calculated cooling water target temperature is above the comparison value.

Finally, if a failure recognition signal Failsafe is present for reasons of safety, the coolant flow can be started up for reasons of safety by opening the heating cut-off valve and by actuating the corresponding valves in the three-way thermostat. A failure recognition signal can for example be generated by self-testing of the control unit or be transmitted by signal lines if other components are operating defectively.

Figure 4:
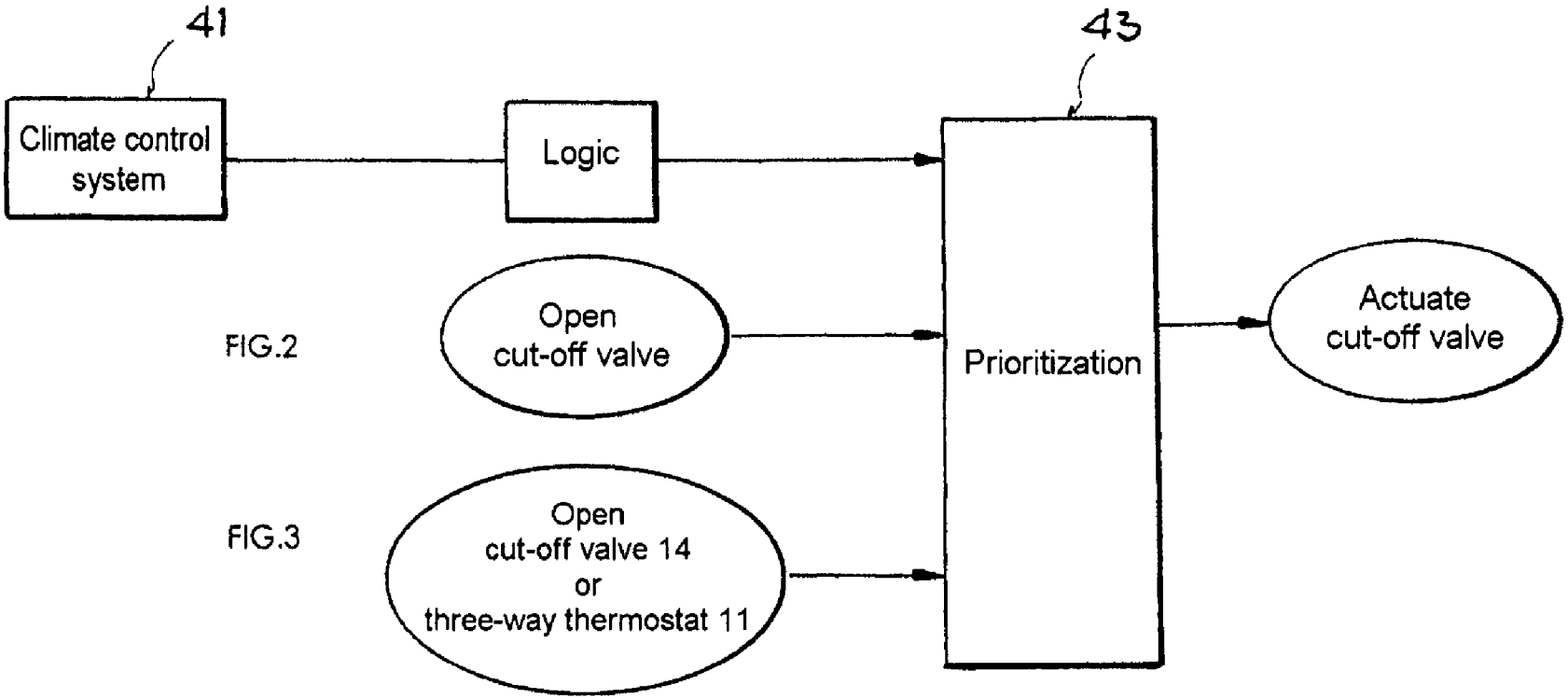
FIG. 4 shows a block diagram of the principle of integrating the invention in a motor vehicle having climate control.

FIG. 4 shows a block diagram for integrating the decision processes from FIG. 2 and FIG. 3 in a motor vehicle having a climate control system 41. Experience has shown that the motor vehicle driver's customer wishes must be incorporated. That is to say, it must be possible for the driver to influence the decision processes as they are illustrated in FIG. 2 and FIG. 3. This is in particular the case when the motor vehicle driver wishes to start up the heating because he is too cold. In this case, after suitable actuation of the heating controller, a signal for a heating demand is sent from the climate control system 41 to the logic of the control unit 5. A superordinate prioritizer 43, which is likewise realized as a software module in the control unit 5, then prioritizes the various demands for actuating the heating cut-off valve, which can be simultaneously present from the heating demand of the climate control system, the actuation of the cut-off valve according to FIG. 2 or the actuation of the cut-off valve according to FIG. 3. In this case, the prioritization allows a certain precedence to be assigned to the heating demand in particular. This precedence is allowed for example by means of a time controller in such a way that after a heating demand has been present for a minimum duration of for example 2 minutes, the heating demand is allowed absolute priority and the heating cut-off valve is opened in any case irrespective of other operating parameters. If desired, the heating demand from the climate control unit can also of course always and in any case be allowed priority as soon as the heating demand is made. In this last-mentioned alternative, however, the virtues of the decision methods according to FIG. 2 and FIG. 3 would be at least partially negated.

The invention claimed is:

1. A method for adjusting the coolant flow from the cooling ducts of an internal combustion engine into a heating heat exchanger with a cut-off valve, with the cooling ducts are additionally connected to an engine cooler via a three-way thermostat, including the steps of interrupting the coolant flow into the heating heat exchanger by the cut-off valve if the temperature of the coolant is below a predefined reference temperature (Ref21*a*, Ref1*b*, Ref2Min), and the coolant flow in the combustion ducts is thus stopped; after a first reference temperature (Ref1*b*) as a preliminary threshold is exceeded, temporarily opening the cut-off valve, so that a wax pellet in the three-way thermostat is pre-heated; and the cut-off valve is subsequently closed again until the coolant temperature has reached a second, higher reference value (Ref1*a*) as an operating threshold.

2. The method as claimed in claim 1, wherein if the temperature of the coolant in a lower temperature range between a lower reference temperature (Ref2Min) and an upper reference temperature (Ref2Max) and a load-dependent, calculated cooling water target temperature simultaneously falls below a third reference value (Ref3), the coolant flow in the cooling ducts of the internal combustion engine is started up by correspondingly opening the cut-off valve or a related valve in the three-way thermostat.

3. The method as claimed in claim 1, wherein the coolant flow is started up by correspondingly opening the cut-off valve or a related valve in the three-way thermostat if the calculated, load-dependent coolant target temperature exceeds a comparison value.

4. A method for adjusting the coolant flow from the cooling ducts of an internal combustion engine into a heating heat exchanger with a cut-off valve, with the cooling ducts are additionally connected to an engine cooler via a three-way thermostat, including the steps of interrupting the coolant flow into the heating heat exchanger by the cut-off valve if the temperature of the coolant is below a predefined reference temperature (Ref21*a*, Ref1*b*, Ref2Min), and the coolant flow in the combustion ducts is thus stopped; and, if the temperature of the coolant in a lower temperature range between a lower reference temperature (Ref2Min) and an upper reference temperature (Ref2Max) and a load-dependent, calculated cooling water target temperature simultaneously falls below a third reference value (Ref3), the coolant flow in the cooling ducts of the internal combustion engine is started up by correspondingly opening the cut-off valve or a related valve in the three-way thermostat.

5. A method for adjusting the coolant flow from the cooling ducts of an internal combustion engine into a heating heat exchanger with a cut-off valve, including the steps of interrupting the coolant flow into the heating heat exchanger by the cut-off valve if the temperature of the coolant is below a predefined reference temperature, and the coolant flow in the combustion ducts is thus stopped; and, the coolant flow is started up by correspondingly opening the cut-off valve if the calculated, load-dependent coolant target temperature exceeds a comparison value.

* * * * *